US005197157A

United States Patent [19]

De La Fuente

[11] Patent Number: 5,197,157

[45] Date of Patent: Mar. 30, 1993

[54] CABLE-STAYED BRIDGES AND MORE PARTICULARLY TO THEIR PYLONS AND STAY CABLES

[75] Inventor: Carlos De La Fuente, Nanterre, France

[73] Assignee: Freyssinet International et Compagnie, Marseille, France

[21] Appl. No.: 719,716

[22] Filed: Jun. 26, 1991

[30] Foreign Application Priority Data

Jun. 29, 1990 [FR] France ..... 90 08250

[51] Int. Cl.[5] ..... E01D 11/00; E04C 3/26

[52] U.S. Cl. ..... 14/18; 52/230; 14/22

[58] Field of Search ..... 14/18-23, 14/77.1; 52/230, 223 L, 223 R, 297

[56] References Cited

U.S. PATENT DOCUMENTS 4,505,081 3/1985 Dinis et al. ..... 52/223 L
4,558,547 12/1985 Nieto ..... 52/223 L
4,799,279 1/1989 Muller ..... 14/18 X
4,977,715 12/1990 Krumbach ..... 52/230 X

*Primary Examiner*—Ramon S. Britts
*Assistant Examiner*—Nancy P. Connolly
*Attorney, Agent, or Firm*—Larson & Taylor

[57] ABSTRACT

A cable-stayed bridge is disclosed comprising at least one pylon (1) and stay cables (2) anchored on this pylon, each stay cable being formed by a bundle of strands or twisted strands (7), the upper portion of each stay cable passing through the pylon from one side to the other and its free end being anchored on a block (3) which bears on the face of the pylon located on the side opposite that where the stay cable is situated. The slightly flared upper portions of two stay cables (2) anchored on the same vertical pylon section (1) and extending on each side of this pylon are crossed with mutual imbrication so that the mean lines of these two portions are both situated in the same vertical plane of the pylon parallel to the longitudinal direction of the bridge.

11 Claims, 3 Drawing Sheets

Figure 1:
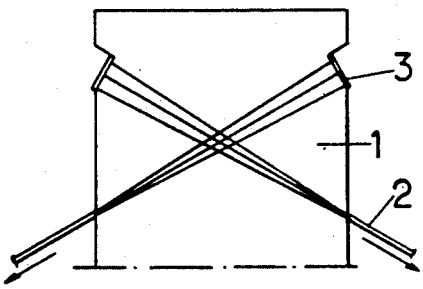

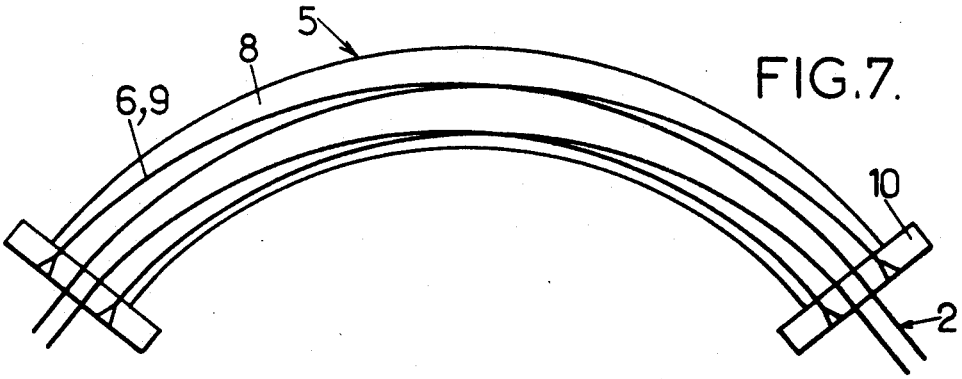
FIG.7.
FIG.8.
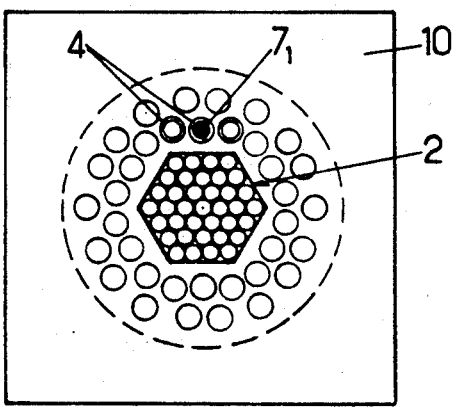
FIG.9.
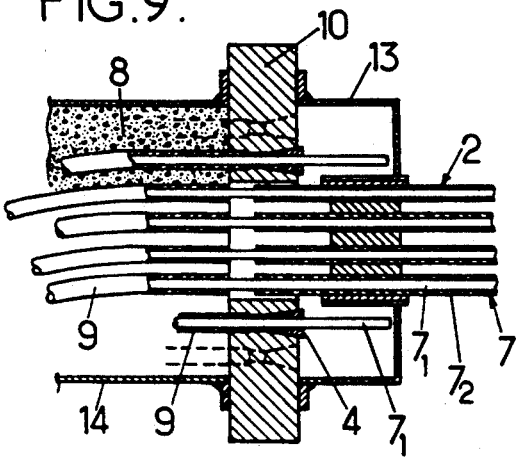
FIG.10.
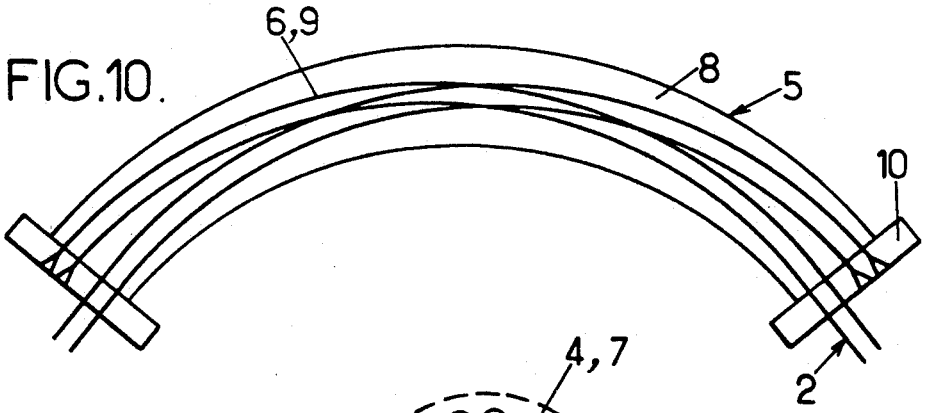
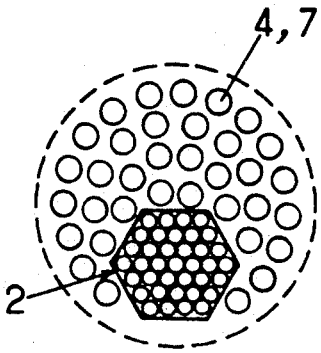
FIG.11.

CABLE-STAYED BRIDGES AND MORE PARTICULARLY TO THEIR PYLONS AND STAY CABLES

The invention relates to cable-stayed bridges comprising a bed plate, at least one concrete pylon and stay cables stretched obliquely between the pylon and the bed plate for supporting it, and it relates more particularly to the pylons and stay cables for such bridges as well as the devices for anchoring the stay cables on the pylons.

It relates more particularly still to the case where each stay cable is formed by a bundle of strands or twisted strands juxtaposed side by side over the greatest part of their length and in which the upper portion of each stay cable passes through the pylon which supports it from one side to the other, the free end of this upper portion being anchored on a block bearing on the face of the pylon located on the side opposite that where the stay cable is situated.

In such assemblies, for the sake of the mechanical strength of the pylon, the simplicity of manufacture and even for aesthetic reasons, the stay cables are grouped in pairs extending obliquely downwards from the same vertical section of the pylon, on each side thereof in the longitudinal direction of the bridge.

But since the stay cables in question have a not inconsiderable overall diameter, especially in their upper portion which is progressively flared towards the end so that the different strands may be individually anchored on the corresponding block, it is not possible to locate the mean lines of the two stay cables of each pair in the same vertical plane extending in the longitudinal direction of the bridge.

This is why, in known embodiments of the above defined assemblies, the mean lines of the two stay cables of each pair are disposed in separate parallel vertical planes.

The zones in which their tensile forces are applied on the pylon are then offset transversely with respect to the longitudinal direction of the bridge, which leads to applying twisting torques on the pylons as well as to a questionable aesthetic appearance.

The object of the invention is in particular to overcome these drawbacks.

For this, cable-stayed bridges of the kind in question according to the invention are essentially characterized in that the different strand sections forming respectively the upper slightly flared portions of two stay cables anchored on the same vertical pylon section and extending on each side of this pylon are crossed with mutual imbrication so that the mean lines of these two portions are both situated in the same vertical plane of the pylon parallel to the longitudinal direction of the bridge.

In preferred embodiments, recourse is further had to one and/or other of the following arrangements:

- for each pair of stay cables anchored on the pylon a rigid prefabricated guide and crossing piece is provided comprising a plurality of tubular guides assigned respectively to the different crossed strand sections,
- the guide piece comprises a hardened cement core formed with channels forming the tubular guides,
- each of the channels is lined with a plastic material tube,
- the core is sheathed in a shuttering casing, plates serving for anchoring the free ends of the strands which pass through this core or serving as base plates for blocks anchoring said ends,
- the guide piece has the general shape of a bridge with two divergent legs corresponding to the start of the two stay cables and an upper horizontal platen bordered by two vertical end sides defined by the perforated plates,
- the guide piece has the general form of a "sausage" curved in an arc of a circle which is open downwards and ends in the two perforated plates, which are oriented perpendicularly to its mean line,
- at each end of the "sausage", the ends of the strands corresponding to the stay cable situated on the other side of the pylon, which ends are spaced relatively apart from each other for individual anchoring thereof, surround the substantially jointing current portions of the strands forming the stay cable which extends obliquely downwards from said "sausage" end.

Apart from these main arrangements, the invention comprises certain other arrangements which are preferably used at the same time and which will be more explicitly discussed hereafter.

In what follows, preferred embodiments of the invention will be described with reference to the accompanying drawings in a way which is of course in no wise limitative.

Figure 2:
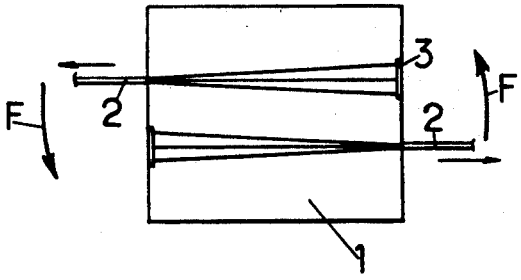
Figure 3:
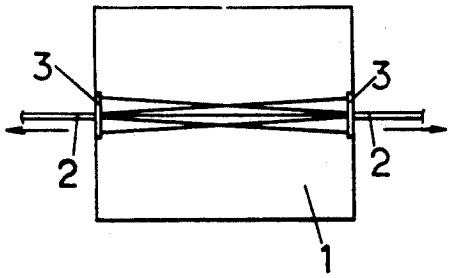
Figure 4:
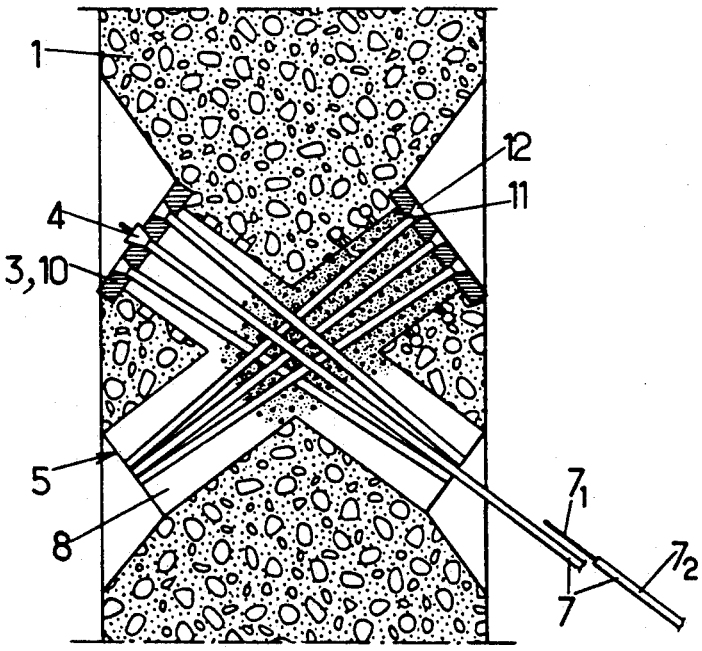
Figure 6:
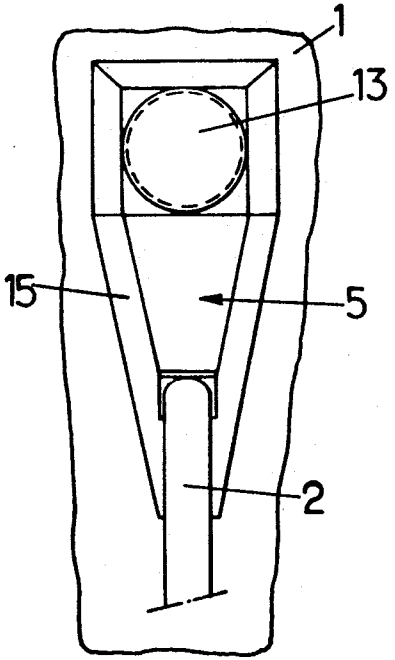
Figure 5:
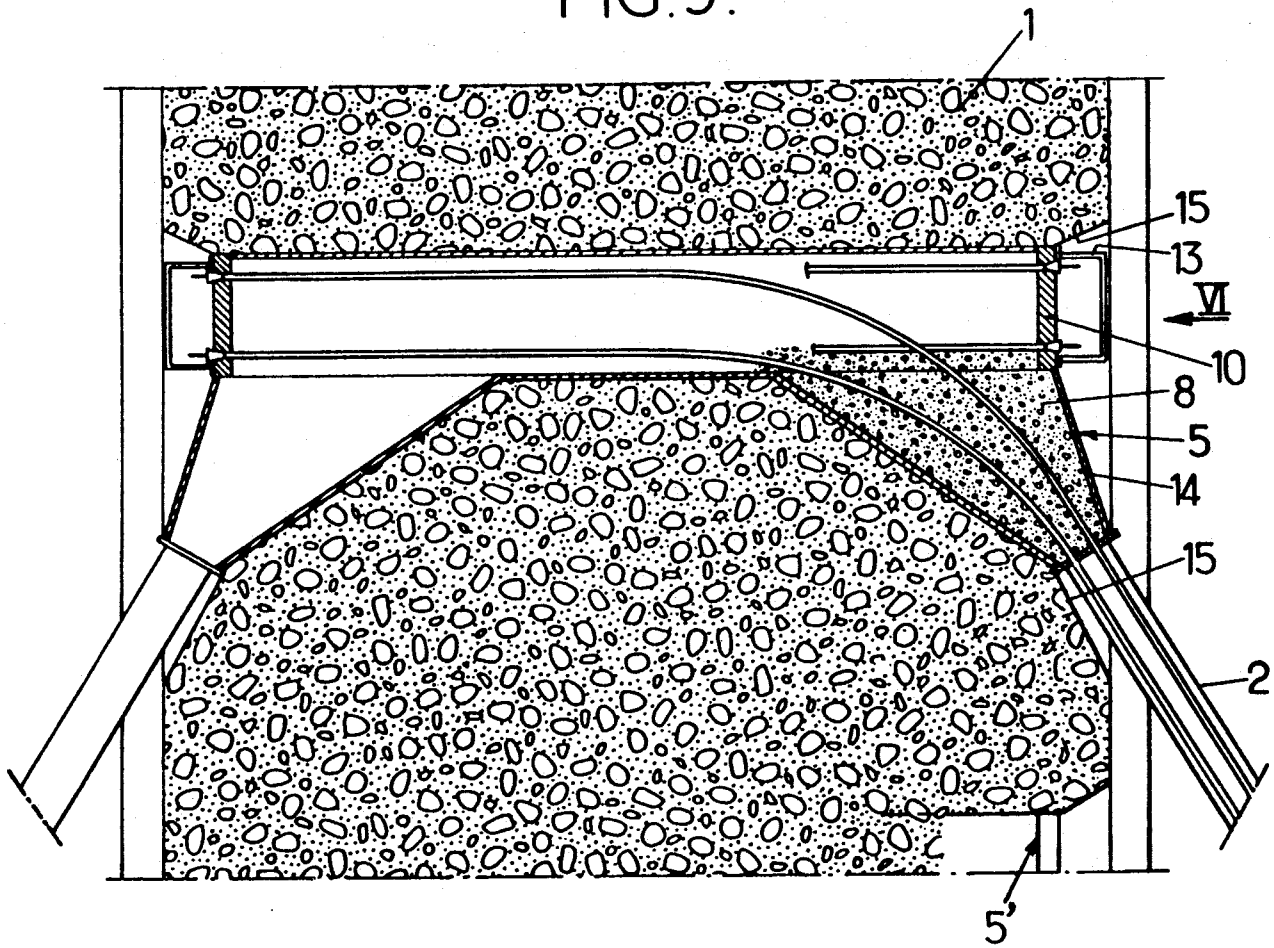

FIG. 1 of these drawings shows schematically the top of a stayed pylon in a side view, FIG. 2 shows schematically from above the same top formed in a way known per se, FIG. 3 shows schematically from above said top constructed in accordance with the invention, FIG. 4 shows in vertical section a stay guide and crossing device constructed and positioned in a pylon in accordance with the invention, FIGS. 5 and 6 show, respectively in vertical section and in an end view along arrow VI of FIG. 5, a variant of such a guide and crossing device also constructed and positioned in accordance with the invention, FIG. 7 shows schematically another stay cable guide and crossing device, FIGS. 8 and 9 show respectively in an end view and in longitudinal section an end of the device shown in FIG. 7, FIG. 10 shows schematically yet another guide and crossing device formed in accordance with the invention, and FIG. 11 shows an end of this latter device in an end view.

Generally, it is a question of anchoring, on a concrete pylon 1 forming part of a cable-stayed bridge, the top ends of two stay cables 2 each formed by a bundle of strands or twisted strands extending obliquely downwards on each side of this pylon so as to connect the latter to the bed plate of said bridge.

The upper section of each stay cable 2 thus passes through the pylon 1 from one side to the other so that its free end is anchored on block 3 which bears horizontally against the pylon.

The bundle of twisted strand sections forming each free stay cable end is then flared towards this end so that each of these sections may pass through a bore in the associated block 3 and an individual anchorage jaw 4 (FIG. 4) bearing on this block.

Since the transverse dimension of each splayed stay cable end is not zero, it is scarcely possible to place the upper flared stay cable ends at the same level of the pylon, with their mean lines merged.

In known embodiments, these two ends are therefore disposed:

either at different levels of the pylon, or else at the same level, but then offset transversely with respect to the longitudinal direction of the bridge, as can be seen in FIG. 2.

In each case, dissymmetric forces are applied on the pylon as a result. In particular, if the stay cables are anchored at positions which are offset transversely, as can be seen in FIG. 2, the pylon is subjected to twisting forces shown symbolically by arrows F.

In addition, the offset positions mentioned are not favourable to the general aesthetic appearance of the bridge.

To overcome these drawbacks, in accordance with the invention, the upper flared ends of the two stay cables are mutually crossed by mutually imbricating their strands in each other.

To guide such mutual crossing of the strands, a prefabricated guide and crossing piece 5 is used comprising a plurality of channels 6 each assigned to a strand or twisted strand 7 forming part of a stay cable 2.

This guide and crossing piece 5 is preferably formed by a hardened cement body or core 8 in which are embedded plastic material tubes 9 open from one end to the other and defining the channels 6.

The body or core 8 has the very general form of an X which may be deformed to a greater or lesser extent while having a symmetry with respect to a vertical transverse median plane.

Two of the legs of this X, symmetrical with each other with respect to said plane, are capped by perforated plates 10.

The perforations 11 of these plates are disposed opposite the mutually spaced apart ends of channels 6 so that the corresponding ends of the strands or twisted strands 7 may pass therethrough.

As can be seen in FIG. 4, these strands or twisted strands 7 are generally "self protected", i.e. formed by a metal core $7_1$ surrounded by a protective sheath $7_2$, generally made from a plastic material, with interpositioning of a protective material such as grease, wax or an epoxy pitch.

As shown in FIG. 9, each sheath $7_2$ is advantageously interrupted at the level of the entrance of the corresponding twisted strand in the "guide piece" 5, this sheath being extended, inside said piece, by a tube 9 having the same diameter and thickness as it.

In the embodiment shown schematically in FIG. 4, each plate 10 itself forms the anchorage block 3, each perforation 11 is extended outwards by a truncated cone shaped bore 12 widening outwards and able to serve as housing for a truncated cone shaped anchorage jaw 4 and each upper strand or twisted strand end 7 is bared so that only the metal core end $7_1$ passes through jaw 4 and so that the end of sheath $7_2$ (or of the tube 9 which is substituted for it) is inserted jointingly in the associated perforation 11.

In a variant, plate 10 does not itself form the anchorage block, which is applied against plate 10, outside this plate.

Protective caps 13 are fitted externally on the anchorage blocks or plates in a way known per se.

The outer face of core 8 may itself be formed by a hard and smooth cement skin formed as a unit therewith, like those which are formed just inside concrete casting moulds or shuttering, during casting thereof.

Said external face may also be defined by an independent casing, more particularly made from a plastic material or from metal sheeting, as can be seen at 14 in FIGS. 5 and 9.

In the first embodiment illustrated in FIG. 4, the X defining the general shape of core 8 is not deformed: it is formed of two rectilinear sections crossed substantially in the middle thereof.

As can be seen in FIG. 4, the whole of piece 5 is embedded in the concrete forming the pylon 1 and the different twisted strands are mounted and individually anchored after manufacture of the pylon.

In the second embodiment illustrated in FIGS. 5 and 6, each of the two upper legs of the X defining the general shape of core 8 is lowered outwardly so that its end extends horizontally and so that the perforated plates 10 which terminate these ends extend vertically.

The whole of the guide and crossing piece 5 then has the general shape of a bridge whose two feet diverge downwards and whose horizontal platen is terminated at both ends by the vertical plates 10.

This construction has the two following advantages:

the vertical overall size of piece 5 and of connecting recesses 15 formed in the transverse faces of pylon 1 is relatively small, which makes it possible to dispose several such pieces in the pylon vertically close to each other: a part of such a second piece has been shown with broken lines at 5' in FIG. 5, the twisted strand ends to be pulled for respective anchoring thereof extend horizontally at the outlets of the plates 10, which facilitates the use of pulling jacks.

In the third embodiment illustrated in FIGS. 7 to 9, the X defining the general shape of core 8 is completely flattened on itself and curved in a downwardly open arc of a circle.

In other words, core 8 has the form of a cylindrical "sausage" extending in an arc of a circle whose extent is for example 90°.

In this case, each of the perforated plates 10 which extend transversely at one end of the "sausage" has each of the two stay cables passing therethrough, the central portion being reserved for passage of the current portion of the stay cable which leaves on the same side as the plate concerned and the periphery being used for anchoring the ends of the other stay cable as can be seen in FIGS. 8 and 9, the twisted strands corresponding to the current stay cable portion are jointing or practically so, whereas the anchored ends are spaced slightly apart from each other.

In the fourth embodiment illustrated in FIGS. 10 and 11, the guide and crossing device 5 has the same general "sausage" arc of a circle shape as that of FIGS. 7 to 9, with its end perforated plates 10.

This fourth embodiment differs from the preceding one in that the current stay cable portion which passes through each plate 10 is located not in the centre of this plate, but in its low part.

Here again, each of the two stay cable ends considered is flared for end anchorage thereof from its current portion inserted in the pylon through a plate 10, the strands forming the current portion being jointing, and the construction is symmetrical with respect to a median transverse vertical plane.

The face defining core 8 outwardly, which face may if required be materialized by a casing 14, has been shown smooth in the different drawings.

In some cases, it may be advantageous to provide on the outside of this face or casing special reliefs such as ribs, scoring, bosses, keys, . . . to improve the adhesion between guide piece 5 and the concrete forming pylon 1.

Following which, and whatever the embodiment adopted, a cable-stayed bridge is finally obtained whose construction is sufficiently clear from the foregoing.

This bridge has numerous advantages with respect to to those known heretofore and in particular the following:

each of the upper stay cable ends anchored on the pylon bears on a plate itself applied horizontally against one of the transverse faces of the pylon, which ensures extremely reliable anchoring as well as longitudinal pre-stressing of the pylon, despite this type of anchoring, the stay cables are disposed in pairs, the two stay cables of each pair being generally disposed symmetrically with respect to the median transverse plane of the pylon so that the forces exerted by these two stay cables on the pylon result in a single vertical force oriented downwards, this symmetry or substantial symmetry of the stay cables in pairs is a factor determining the general aesthetic appearance of the bridge.

As is evident, and as it follows moreover already from what has gone before, the invention is in no wise limited to those of its modes of application and embodiments which have been more especially discussed., it embraces, on the contrary, all variants thereof, particularly those in which the two stay cables of the same pair, although having their upper ends still anchored on the pylon at the same level and still crossed so that their mean lines are situated in the same longitudinal vertical plane of the bridge, are not quite symmetrical with each other with respect to the median transverse plane of the pylon, the inclinations of the two stay cables considered with respect to the horizontal then not being identical and the tensions exerted on each of them not being equal to each other.

I claim:

1. Cable-stayed bridge comprising:

at least one pylon including opposite vertical sides having faces;

a respective block for each respective said vertical side of said pylon which bears on an associated said face of the respective said vertical side; and a pair of stay cables which are anchored to said pylon and which extend from respective said opposite vertical sides, wherein each said stay cable is formed by a bundle of strands, wherein each said stay cable includes a main portion extending from one said vertical side of said pylon, an upper portion passing through said pylon from the one said vertical side to the other with said upper portion slightly flared from the one said side into strand sections, and free ends of said strand sections which are anchored to an associated said block located at the other said side, and wherein said strand sections of said pair of stay cables are crossed with mutual imbrication in said pylon so that mean center lines of said flared upper portions of said stay cables are anchored in a same vertical plane of said pylon which is parallel to a longitudinal direction of the bridge.

2. Cable-stayed bridge as claimed in claim 1 and further including a rigid prefabricated guide and crossing piece including a plurality of tubular guides in which respective said strand sections are located.

3. Cable-stayed bridge as claimed in claim 2 wherein said guide and crossing piece includes a hardened cement core having channels therein which form said tubular guides.

4. Cable-stayed bridge as claimed in claim 3 wherein said channels are lined with a plastic material tube.

5. Cable-stayed bridge as claimed in claim 3 wherein said guide and crossing piece includes a shuttering casing which sheaths said core.

6. Cable-stayed bridge as claimed in claim 3 wherein said guide and crossing piece includes respective perforated plates attached to said core through which pass respective said free ends of the respective said strand sections.

7. Cable-stayed bridge as claimed in claim 6 wherein said perforated plates serve as said blocks to which said free ends of said upper portions of said stay cables are anchored.

8. Cable-stayed bridge as claimed in claim 6 wherein said perforated plates serve as respective base plates against which an associated said block bears.

9. Cable-stayed bridge as claimed in claim 6 wherein said guide and crossing piece has a general bridge shape and includes a) an upper horizontal platen having two vertical ends sides where said perforated plates are respectively located and b) a pair of legs which are respectively located adjacent respective said vertical end sides, which depend from said horizontal platen and which diverge from one another.

10. Cable-stayed bridge as claimed in claim 6 wherein said guide and crossing piece is arc shaped and oriented to open downwardly, and includes opposite end sides at which respective said perforated plates are oriented perpendicular to a mean centerline of said arc shape.

11. Cable-stayed bridge as claimed in claim 10 wherein respective said free ends of each said stay cable located at each said perforated plate surround said upper portion of the other said stay cable also passing through the associated said perforated plate.

* * * * *